US010319489B2

(12) United States Patent
Ren et al.

(10) Patent No.: US 10,319,489 B2
(45) Date of Patent: Jun. 11, 2019

(54) SCRATCH RESISTANT FLEXIBLE TRANSPARENT ELECTRODES AND METHODS FOR FABRICATING ULTRATHIN METAL FILMS AS ELECTRODES

(71) Applicant: University of Houston System, Houston, TX (US)

(72) Inventors: Zhifeng Ren, Houston, TX (US); Chuanfei Guo, Houston, TX (US); Yuan Liu, Houston, TX (US)

(73) Assignee: UNIVERSITY OF HOUSTON SYSTEM, Houston, TX (US)

( * ) Notice: Subject to any disclaimer, the term of this patent is extended or adjusted under 35 U.S.C. 154(b) by 11 days.

(21) Appl. No.: 15/547,033

(22) PCT Filed: Feb. 10, 2016

(86) PCT No.: PCT/US2016/017408
§ 371 (c)(1),
(2) Date: Jul. 27, 2017

(87) PCT Pub. No.: WO2016/130717
PCT Pub. Date: Aug. 18, 2016

(65) Prior Publication Data

US 2018/0025804 A1 Jan. 25, 2018

Related U.S. Application Data

(60) Provisional application No. 62/114,550, filed on Feb. 10, 2015, provisional application No. 62/146,759, filed on Apr. 13, 2015.

(51) Int. Cl.
*H01B 1/16* (2006.01)
*H01B 13/00* (2006.01)
(Continued)

(52) U.S. Cl.
CPC ..... *H01B 1/16* (2013.01); *G03C 1/00* (2013.01); *H01B 1/023* (2013.01); *H01B 1/026* (2013.01); *H01B 1/22* (2013.01); *H01B 13/0036* (2013.01)

(58) Field of Classification Search
CPC ..... H01L 51/5203; H01L 51/5215; H01L 51/5256; H01B 1/023; H01B 1/026;
(Continued)

(56) References Cited

U.S. PATENT DOCUMENTS 7,815,982 B2 * 10/2010 Iwanaga ..... H01L 51/5256 428/1.1
2002/0076940 A1 6/2002 Hibino
(Continued)

FOREIGN PATENT DOCUMENTS

KR 10-2015-0004576 A 1/2015

OTHER PUBLICATIONS

PCT/US2016/017408 International Search Report and Written Opinion dated May 18, 2016 (13 p.).

*Primary Examiner* — Roshn K Varghese
(74) *Attorney, Agent, or Firm* — Conley Rose, P.C.

(57) ABSTRACT

Systems and methods of fabricating electrodes, including thin metallic films, include depositing a first metallic layer on a substrate and passivating the deposited layer. The processes of deposition and passivation may be done sequentially. In some embodiments, a plurality of substrates may be coated with a metallic layer and further processed at a later time, including passivation and disposal of additional layers as discussed herein.

18 Claims, 9 Drawing Sheets

(51) Int. Cl.

| | |
|---|---|
| ***H01B 1/02*** | (2006.01) |
| ***H01B 1/22*** | (2006.01) |
| ***G03C 1/00*** | (2006.01) |

(58) Field of Classification Search
CPC ..... H01B 1/16; H01B 1/22; H01B 13/0036; G03C 1/00
See application file for complete search history.

(56) References Cited

U.S. PATENT DOCUMENTS

| | | | | |
|---|---|---|---|---|
| 2005/0280008 | A1* | 12/2005 | Ricks | C09K 11/06 257/79 |
| 2006/0086979 | A1* | 4/2006 | Kim | G02F 1/136286 257/347 |
| 2008/0038529 | A1* | 2/2008 | Nakayama | C23C 14/08 428/220 |
| 2008/0174872 | A1 | 7/2008 | Morimoto et al. | |
| 2009/0093082 | A1 | 4/2009 | Su | |
| 2010/0164373 | A1* | 7/2010 | Kobayashi | H01L 27/3239 313/504 |
| 2014/0170413 | A1 | 6/2014 | Hassan et al. | |
| 2016/0233357 | A1* | 8/2016 | Lee | H01L 31/1884 |

* cited by examiner

SCRATCH RESISTANT FLEXIBLE TRANSPARENT ELECTRODES AND METHODS FOR FABRICATING ULTRATHIN METAL FILMS AS ELECTRODES

CROSS-REFERENCE TO RELATED APPLICATIONS

This application is a 35 U.S.C. § 371 national stage application of PCT/US2016/017408 filed Feb. 10, 2016, and entitled "Scratch Resistant Flexible Transparent Electrodes and Methods for Fabricating Ultrathin Metal Films as Electrodes," which claims priority to U.S. Provisional App. No. 62/114,550, "Method for Fabricating Ultrathin Metal Films as Scratch Resistant Flexible Transparent Electrodes," filed Feb. 10, 2015, and U.S. Provisional App. No. 62/146,759, "Method for Fabricating Ultrathin Metal Films as Scratch Resistant Flexible Transparent Electrodes," filed Apr 13, 2015, each of these applications being incorporated herein by reference in its entirety for all purposes.

RESEARCH OR DEVELOPMENT

The work disclosed herein was funded by the Department of Energy under grant DE-FG02-00ER45805 and DE-SC0010831.

BACKGROUND

Metals are favorable candidates for flexible transparent electrodes because they have high electrical conductivity and good ductility. Theoretically, ultrathin metal films can present low sheet resistance and high transmittance simultaneously. However, due to Ostwald ripening, many metal films may tend to form in island growth mode, leading to isolated metal islands and non-conducting features until the films become relatively opaque at a thickness beyond a percolation threshold. Presented herein is a new vacuum deposition method that can effectively suppress the Ostwald ripening in metal films, which become conducting at a thickness much smaller than the percolation threshold. The conducting and transparent metal films are smooth and scratch resistant, and are stretchable by forming distributed ruptures upon stretching. This work presents a new and versatile strategy to fabricate scratch resistant flexible transparent electrodes.

BRIEF SUMMARY OF THE DISCLOSURE

In an embodiment, a method of fabricating an electrode comprising: depositing a first metallic layer on a substrate; forming a first film on the first metallic layer; depositing a second metallic layer in contact with the first film; and forming a second film on the second metallic layer.

In an embodiment, an electrode comprising: a plurality of metallic layers deposited on a substrate; and an oxide layer between each adjacent pair of metallic layers, wherein the electrode comprises an optical transmittance of up to about 89%.

In an embodiment, an electrode comprising: a plurality of metallic layers deposited on a substrate; and a plurality of passivated layers, wherein each passivated layer of the passivated layers is in between each adjacent pair of metal layers deposited on the substrate, wherein the electrode comprises an optical transmittance of up to about 89%.

Exemplary embodiments described herein comprise a combination of features and characteristics intended to address various shortcomings associated with certain prior devices, compositions, systems, and methods. The various features and characteristics described above, as well as others, will be readily apparent to those of ordinary skill in the art upon reading the following detailed description, and by referring to the accompanying drawings.

BRIEF DESCRIPTION OF THE DRAWINGS

For a detailed description of the exemplary embodiments disclosed herein, reference will now be made to the accompanying drawings in which.

DETAILED DESCRIPTION OF EXEMPLARY DISCLOSED EMBODIMENTS

Figures 1A, 1B:
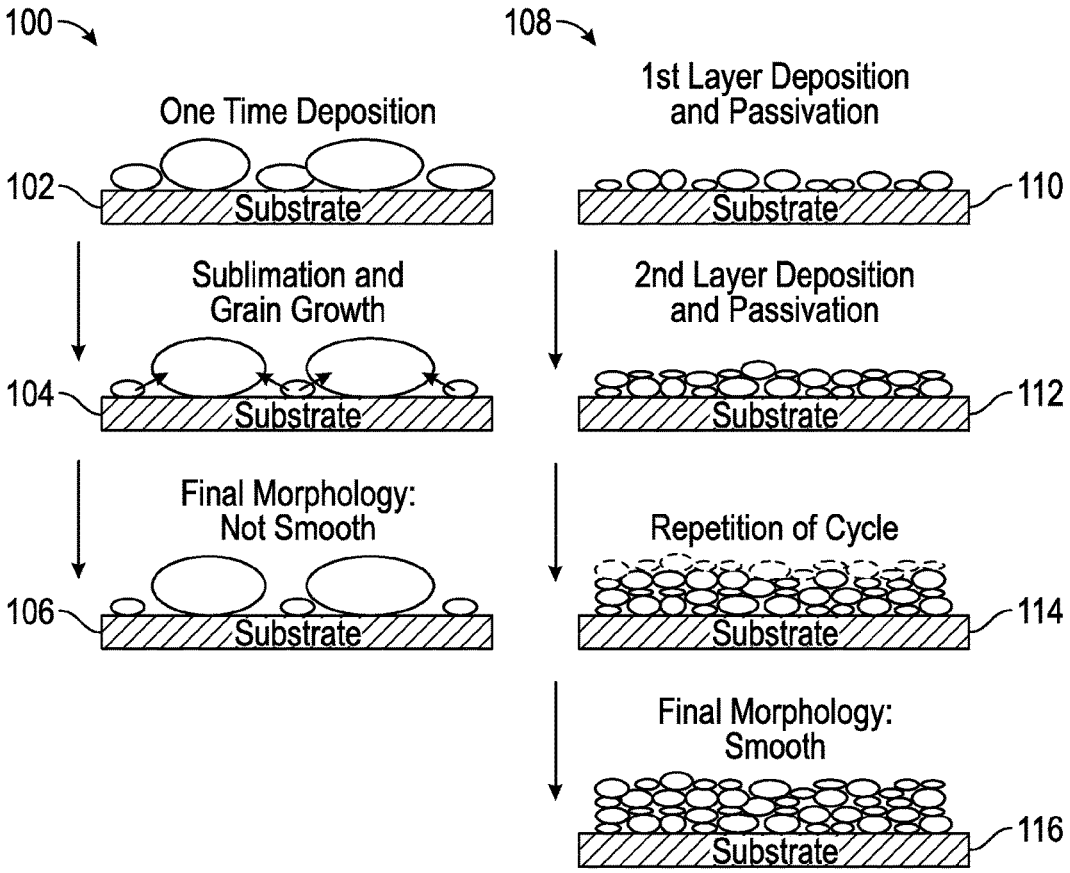
FIGS. 1A and 1B present a schematic comparison between conventional metal film deposition and the fabrication method according to embodiments of the present disclosure.

The following discussion is directed to various exemplary embodiments. However, one of ordinary skill in the art will understand that the examples disclosed herein have broad application, and that the discussion of any embodiment is meant only to be exemplary of that embodiment, and not intended to suggest that the scope of the disclosure, including the claims, is limited to that embodiment.

The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ."

Flexible transparent electrodes (FTEs) are employed in a number of optical and electronic applications such as flexible solar cells, foldable photoelectronics and muscle-like transducers. As used herein, the term "flexible" is used to mean a film or substrate that can be bent, twisted, folder, stretched, or combinations thereof without negatively impacting the functionality of the film or substrate. Metals and metallic materials may be employed in FTEs because of properties and characteristics high electrical conductivity and good mechanical properties such as ductility. The performance of FTEs tied to not only the materials used and method of manufacture, but also on the structure of the FTE, e.g., the configuration of the materials as well as the material properties of those materials and the interaction of the materials based on their configuration within the FTE structure.

Despite the performance advantages of metal nanostructures such as those comprising Au, Cu, or Ag, a number of disadvantages may be associated with nanostructures as well. One challenge of using metal nanostructures is that the surfaces of these nanostructured materials may not be smooth enough to be favorable for FTE device fabrications due to the limited compatibility of rougher surfaces with thin film technology. Another problem lies in the fabrication method.

The fabrication of metal nanostructures may comprise patterning or complicated synthesis procedures, which may be costly and lead to difficulty producing such electrodes in large quantities and/or on a larger scale. Usage of solutions, for example, for solution processing of nanowires, etching templates, etc., would also increase the chance of contamination during fabrication process.

As such, discussed herein are physical deposition techniques employed to make ultrathin metal films of sufficient smoothness to be employed in thin-film applications such as FTEs. Metal deposition techniques, such as vacuum evaporation and sputtering, were employed, and the systems and methods discussed herein comprise a dry process which reduces if not eliminates the risk of contamination. Discussed herein are methods and systems for fabricating flexible, optically transparent, and conducting Ag films by using multi-layer sputtering and passivation to avoid grain growth. Through the formation of a thin oxide coating on each grain, the Ostwald ripening is sufficiently suppressed, and a continuous and homogeneous grain growth is promoted. Electrical conductivity of Ag films is greatly improved due to the smooth and continuous morphology and the electrical percolation threshold is reduced to less than 5 nm. The good stretchability and fast recovery are the results of distributed ruptures under tensile strains. The good plasticity of the film increased the resistance to scratching.

One challenge in depositing ultrathin and smooth metal films using deposition techniques is due to the Ostwald ripening. For high transparency purposes, films are preferred to be as thin as possible. However, during the initial deposition, the metal grains tend to form isolated islands on the substrate, leading to a non-continuous surface. This phenomenon is caused by the mass transfer of metal vapor from small grains to larger ones is driven by the different vapor pressures between islands with different sizes. Typically, grains with a smaller radius have a higher saturated vapor pressure. The tendency of island growth instead of formation of a continuous and flat layer of small grains greatly limits the electrical conductivity of metal film at small thicknesses. As used herein, a "continuous" layer is a layer which is unbroken, that is, a layer which covers a substrate in a predetermined region without holes, tears, breaks, or other voids. In order to be electrically conductive, a critical thickness (percolation threshold) between 10-20 nm may be desirable, which in turn may limit the transparency. Thus, an approach to overcome the Ostwald ripening is needed in order to solve this dilemma.

The systems and methods discussed herein comprise a new approach to fabricate ultrathin and smooth Ag films based on a multi-layer deposition, for which each layer is passivated. This method is highly effective in suppressing the ripening effect. A schematic drawing of the fabrication procedure is shown in FIGS. 1A and 1B. FIG. 1A illustrates the conventional method 100 of fabricating Ag-films, where there is a deposition at block 102, a sublimation and grain growth at block 104 of the layer deposited at block 102, and a final morphology as shown at block 106 resulting from the sublimation and growth at block 106.

In contrast, FIG. 1B is an embodiment of a method 108 of fabricating thin metallic films. At block 110, a first metallic layer may be disposed on a substrate and passivated. This first metallic layer may range in thickness from about 0.5 nm to about 5 nm. In other embodiments, the first metallic layer, and/or subsequent layers, may range from about 0.5 nm to about 5 nm, or from about 1.0 nm to about 3.0 nm, and in other embodiments from about 2.0 nm to about 4.0 nm. The processes of deposition and passivation at block 110 may be done sequentially. In some embodiments, a plurality of substrates may be coated with a metallic layer and further processed at a later time, including passivation and disposal of additional layers as discussed herein. Passivation, for example at block 110, is performed subsequent to the deposition of the first metallic layer and comprises a process that forms a thin oxide coating, which stops the sublimation of smaller grains and inhibits further growth of the larger grains, thus effectively suppressing the subsequent grain coarsening. In this way, the grain size in each layer is kept level, in one embodiment less, each than about 20 nm, forming a relatively smooth conducting film at a much smaller film thickness, for example, as thin as 0.5 nm. A "relatively smooth" conducting film is a film comprising a smoothness that enables it to provide the desired function in a target application.

The oxide coating formed during passivation at block 110, which is only a few atomic layers thick, will not negatively affect the transparency and conductance of the Ag film. At block 112, a second metallic layer is deposited on top of the first passivated layer deposited at block 110. At block 114, the deposition of the metallic layer and the passivation may be repeated iteratively for as many cycles as is desirable for the end thin-film product. The final morphology formed in method 108 and illustrated at block 116 is a smoother morphology than that produced by the conventional method 100 in FIG. 1A. That is, the thin film layer formed in the method 108 in FIG. 1B comprises a continuous film exhibiting a uniform film thickness that may be more desirable for a plurality of applications. In an embodiment, a "uniform" thickness may be a thickness of a layer wherein the difference between maximum and the minimum thicknesses is within 20% of the average thickness of the layer In some embodiments, the metallic layer disposed at block 110 may be silver (Ag), and a metallic layer of the same type may be disposed at block 112. In other embodiments, the metallic layers disposed at blocks 110 and 112 are different compositions, and subsequent layers disposed at block 114 may be the same metallic or different metallic compositions comprising varying thicknesses, depending upon the desired end film thickness and application. In an alternate embodiment, the metallic layers disposed at blocks 110 and 112 and subsequent iterations may comprise copper (Cu), aluminum (Al), silver (Ag), other materials with viable conductivity, or combinations and alloys thereof.

Thermoelectric Materials and Embodiments of Methods of Material Fabrication

Ag films of several nanometers (2 nm or greater in one embodiment) comprising a plurality of layers were deposited on glass, silicon, and Polydimethylsiloxane (PDMS) substrates or tapes, and on ultrathin carbon film on copper grids for TEM observations, using magnetron sputtering at room temperature. The films may be referred to as "ultrathin" because the thickness of the plurality of layers (e.g., not each layer of the plurality) may be less than about 2 nm, and in other embodiments may be less than about 15 nm. The deposition procedure discussed in various embodiments herein comprises three steps: (1) metal deposition in vacuum sputtering system (which may be similar to block 110 in FIG. 1), (2) exposure of deposited metal films to air or oxygen gas for 30-60 s to form a thin oxide coating on metal layer (which may be similar to block 110 in FIG. 1), and (3) repetition of this cycle until reaching the desired thickness (which may be similar to blocks 112 and 114 in FIG. 1). In an embodiment, an electrode employing the ultrathin films discussed herein may be less than about 15 nm thick.

Morphology of the as-prepared films was observed by scanning electron microscopy (SEM) and transmission electron microscopy (TEM). Optical transmittance was measured by a Hitachi 2100U Spectrometer. Sheet resistance was measured by a two-probe method. The stretching experiments were conducted with a home-made setup, while the resistance was measured by a two-probe method.

Figure 9:
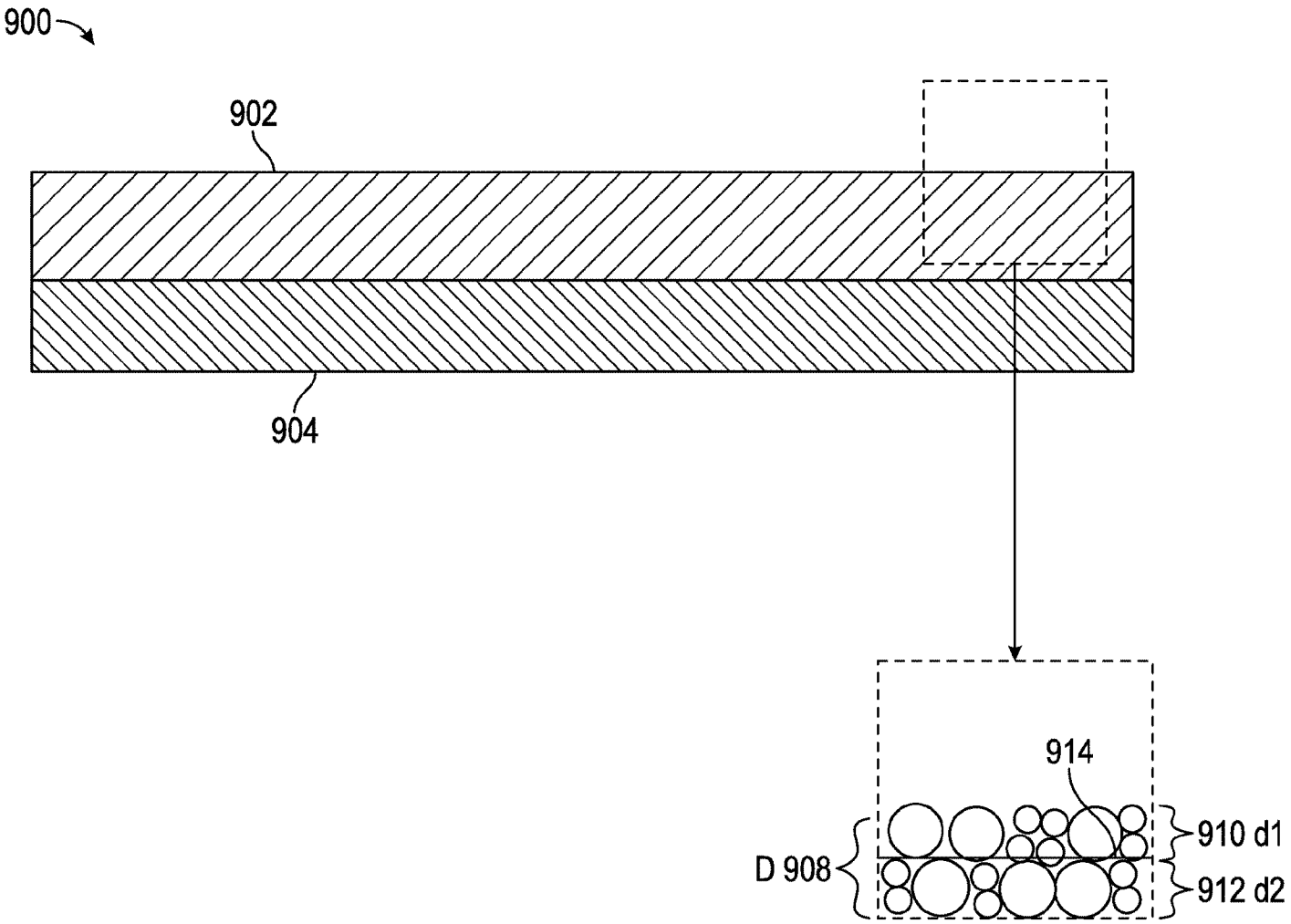
FIG. 9 is a schematic illustration of a thin film fabricated according to certain embodiments of the present disclosure.

Referring now to FIG. 9, the schematic illustration of a cross section 900 of a thin film structure fabricated according to embodiments of the present disclosure is shown. The metallic film 902 may be deposited in one or more layers on a substrate 904 which may comprise glass, silicon, or a polymer. The exploded view in FIG. 9 illustrates the overall thickness D/908 of the metallic film 902, as well as the thickness of two individual metallic layer depositions, d1/910 and d2/912. In this example, the two metallic layer depositions 910 and 912 are shown as being a similar thickness, but in other embodiments there may be more layers which may be of varying thicknesses and compositions. Also illustrated is a film 914 formed between the layers 910 and 912, it is appreciated that the film 914 is illustrated as a single darkened line in order to illustrate its location, and not as an indication of a relative thickness, color, or other material property of the film 914. As discussed herein, the film 914 may be an oxidized layer formed by passivation or other methods, and may be less than about 0.05 nm in average thickness.

Figure 2A:
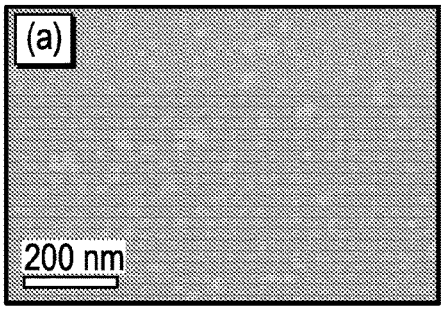
FIGS. 2A-2H are scanning electron microscopy (SEM) images of samples fabricated according to certain embodiments of the present disclosure deposited on silicon substrates and glass substrates.

In an embodiment, a metallic layer may comprise a single layer of metallic particles and in alternate embodiments, a metallic layer may comprise a plurality of layers of metallic particles. In an embodiment, each layer of the plurality of layers deposited may range from 0.5 nm to about 10 nm, and may be deposited in one or more steps/processes. The total thickness of a coating is $D=n\times d$, where n is the number of layers/deposition, and is equal to 2 in this example, and d is the thickness of each layer/deposition. In some embodiments, individually deposited layers such as layers 910 and 912 may be about 1.7 nm, 2.2 nm or 2.8 nm thick when the source power of Ag target is held at 30 W, 40 W and 50 W, respectively. In alternate embodiments, thickness d of each layer may be from about 0.5 nm to about 10 nm, and n may be from about 1 to about 10. In one embodiment, the first metallic layer deposition d1/910 may comprise a first type (composition) of metallic material and the second metallic layer deposition d2/912 may comprise a second type (composition) of metallic material. The first type may be different from the second type, or may be an alloy or combination of the first type and other elements or alloys. The metallic layer depositions 910 and 912 and subsequently deposited layers may be of varying thicknesses in combinations as appropriate for a desired end application or target property. In an embodiment, the structure 900 may further comprise an anti-reflect Surface Morphology Turning to FIGS. 2A-2H, the SEM images of samples deposited on silicon substrates and glass substrates. FIG. 2A is an SEM image of a film comprising a single layer thickness of 2.8 nm, FIG. 2B is an SEM image of a film comprising a 2-layer thickness (2 deposition/passivation cycles) with each layer comprising a thickness of about 2.8 nm, and FIG. 2C is an SEM image of a film comprising a 3-layer thickness (three deposition/passivation cycles) which each of the three layers about 2.8 nm thick. FIG. 2D is an SEM image of a film comprising a single 7 nm thick layer of Ag deposited on a silicon substrate, and FIG. 2H is an SEM image of a film comprising a single 7 nm thick layer of Ag film deposited on a glass substrate. As observed, the surface of FIGS. 2D and 2H are rough and porous, and composed of a number of large and coarse grains (which may be up to about 50 nm in maximum diameter). In contrast, the images in FIGS. 2A-2C are apparently different. They show a relatively continuous and smooth surface with much smaller grain size.

Figure 2E:
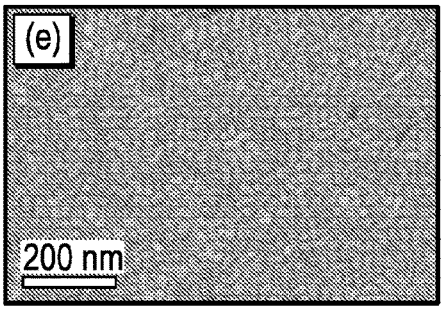
Figure 2B:
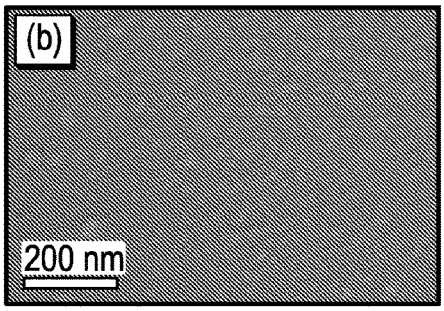
Figure 2F:
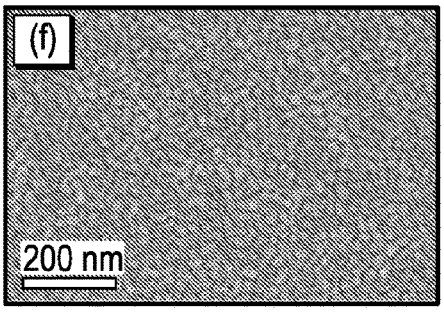
Figure 2C:
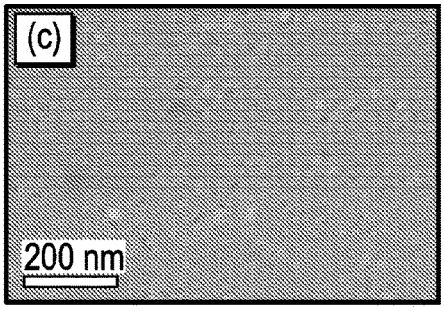
Figure 2G:
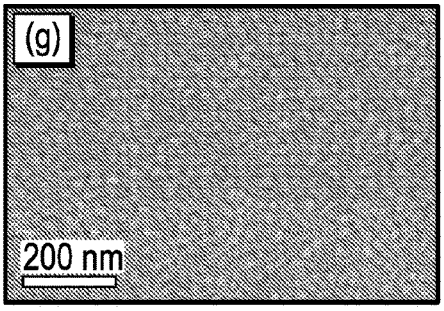
Figure 2D:
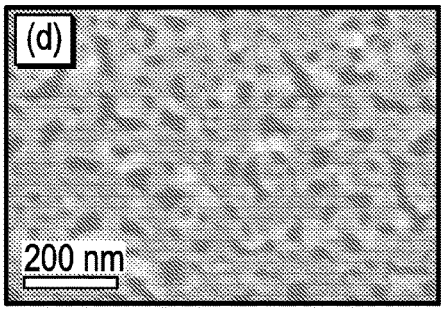
Figure 2H:
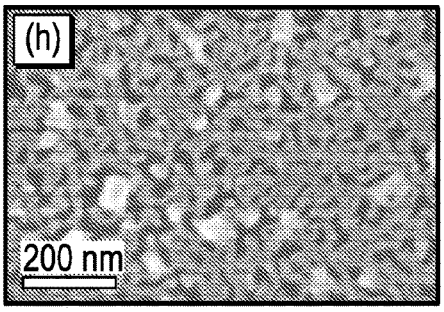

FIG. 2E is an SEM image of a film comprising two layers (depositions) of Ag, each deposited in about a 2.8 nm thickness on a glass substrate. FIG. 2E is an SEM image of a film comprising three layers (depositions) of Ag, each deposited in about a 2.8 nm thickness on a glass substrate. FIG. 2F is an SEM image of a film comprising four layers of Ag, each deposited in about a 2.8 nm thickness on a glass substrate. FIGS. 2D-2F indicate similar surface morphology and grain size (less than about 20 nm maximum diameter), indicating that the inhomogeneous grain growth caused by Ostwald ripening during deposition process was successfully suppressed by the slight oxidation between two sequential depositions. As a result, the film is continuous, flat, and uniform, even at a small thickness, and the grain size keeps unchanged no matter how many layers are deposited.

Figure 3A:
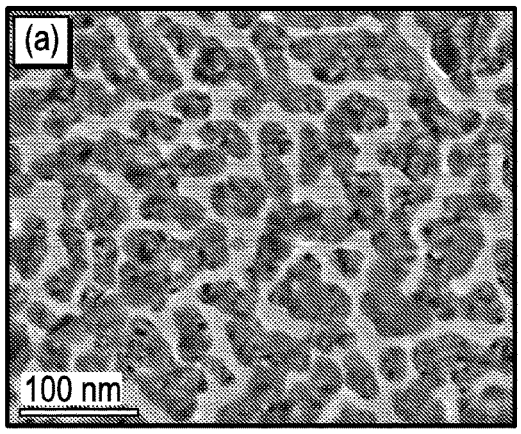
FIGS. 3A-3D are transmission electron microscopy (TEM) images and an electron diffraction pattern for thin films fabricated according to certain embodiments of the present disclosure.
Figure 3B:
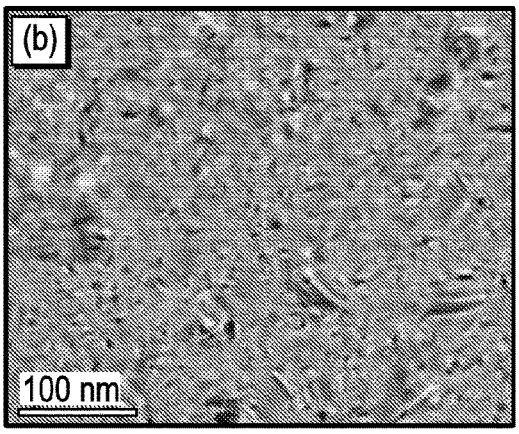
Figure 3C:
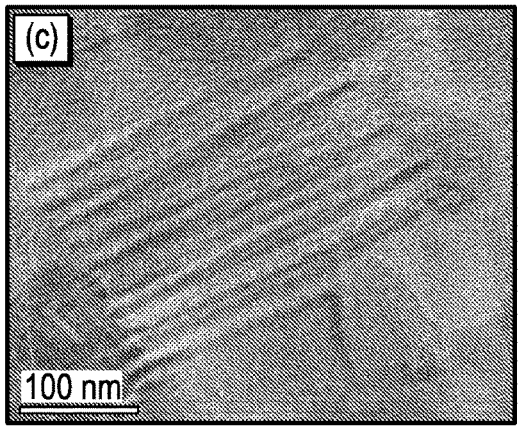
Figure 3D:
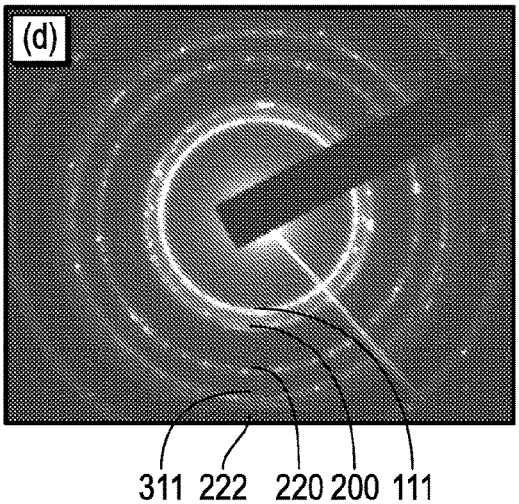

Transmission electron microscopy (TEM) images in FIGS. 3A and 3B show the drastically different surface morphologies of 8 nm thick Ag films deposited with n=1, d=8 nm (FIG. 3A), and n=4, d=2 nm (FIG. 3B). The isolated islands of the 1 layered Ag film can be clearly seen from FIG. 3A, while for the same total thickness, the 4 layered Ag film shows a continuous morphology as well as finer grains, shown in FIG. 3B and the corresponding high resolution TEM image is shown in FIG. 3C. No apparent grain boundaries are observed, which may indicate that the oxide coating on the grains is very thin, and therefore will not significantly affect the electrical performance of the Ag films. FIG. 3D presents the electron diffraction pattern of the Ag film in FIG. 3C, indicating the face-centered cubic crystal structure of Ag. No presence of other phases can be seen from the diffraction patterns, which might be due to the thickness (<0.5 nm) and amorphous nature of the coating. Although too thin (e.g., less than about 0.5 nm) to be detected by TEM, an atomic layer thick oxide coating is sufficient enough to obstruct the condition of homoepitaxy for metal grain growth caused by ripening.

Sheet Resistance and Optical Transmittance

Figure 4A:
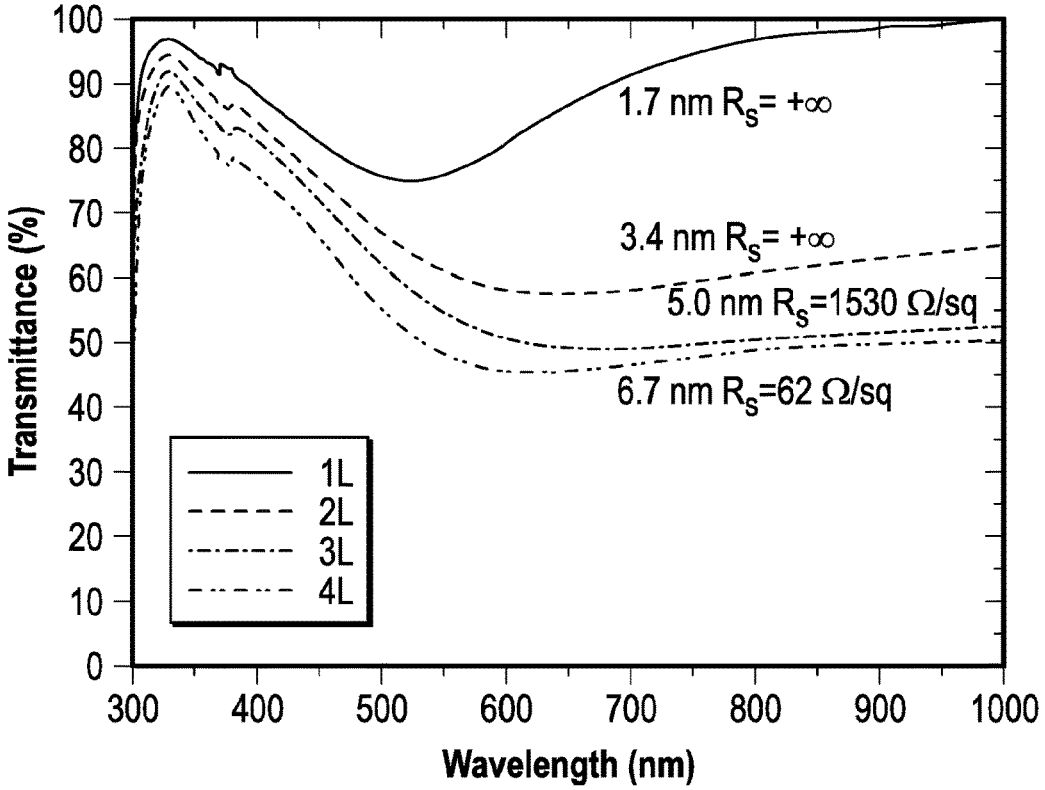
FIGS. 4A-4D illustrate the optical transmittance spectra and sheet resistance of a plurality of multi-layer metallic films fabricated according to certain embodiments of the present disclosure.
Figure 4B:
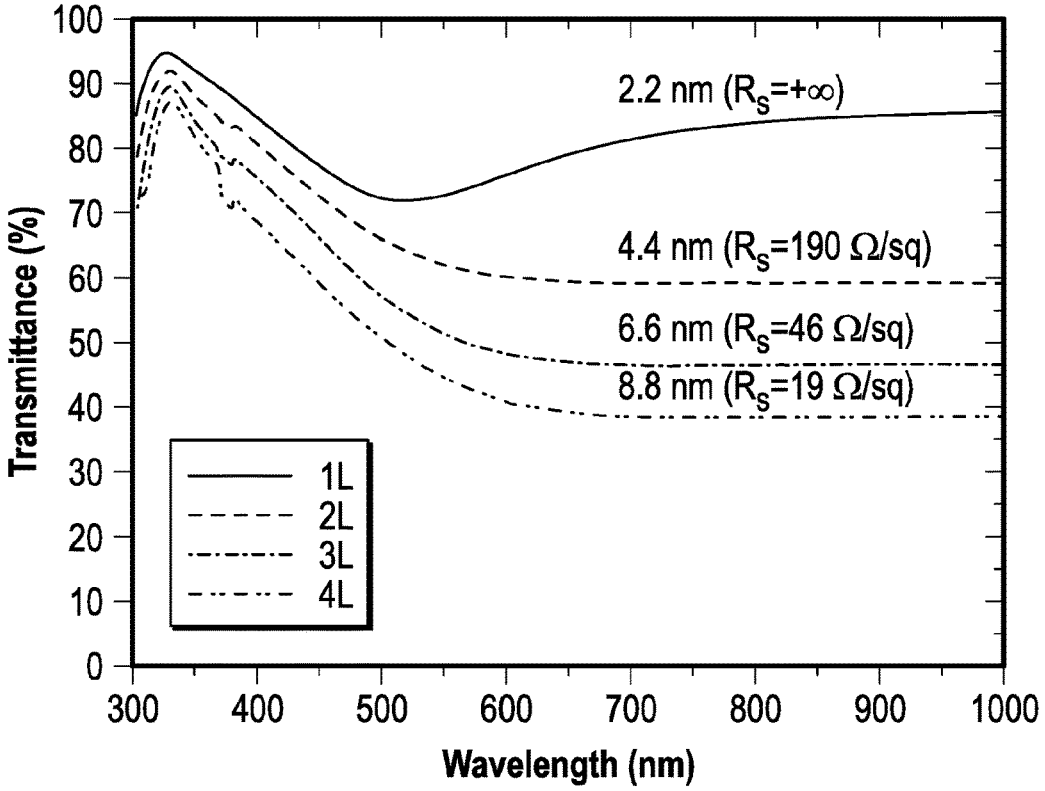
Figure 4C:
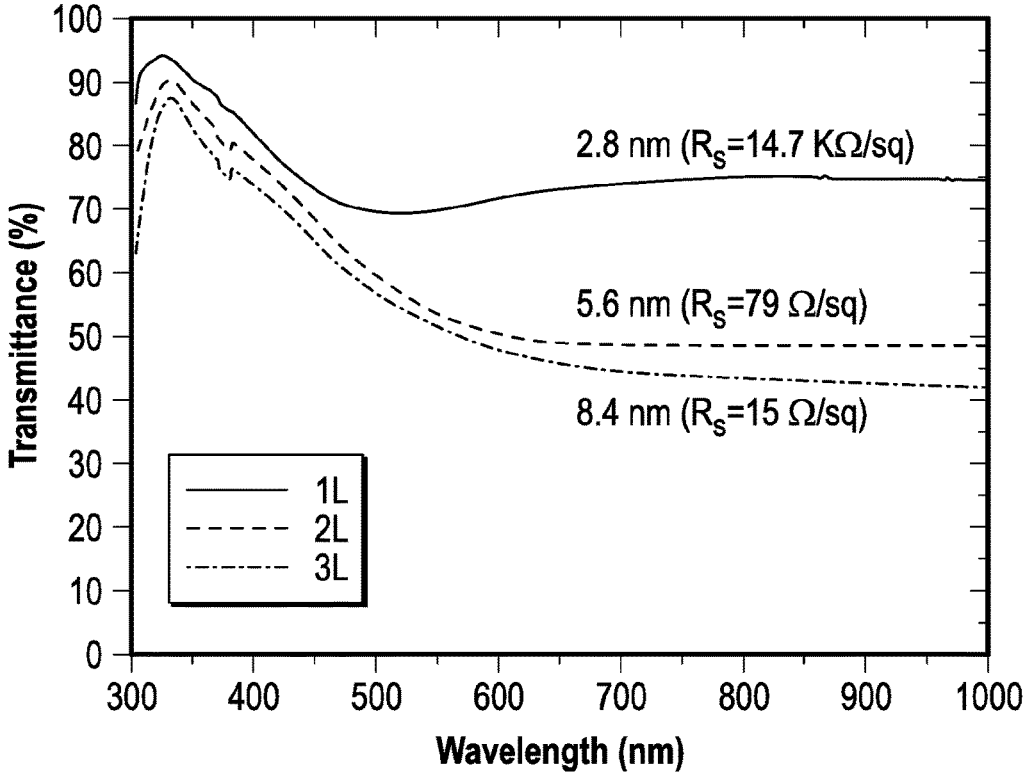

Referring now to FIGS. 4A-4D, FIG. 4A illustrates the optical transmittance spectra and sheet resistance of thin films fabricated according to embodiments of the present disclosure with varying thicknesses of D from about 1.7 nm to about 8.8 nm. FIGS. 4A-4C shows the optical transmittance spectra and the sheet resistances of Ag films deposited on glass substrates, with d (as discussed in FIG. 9). FIG. 4A illustrates the transmittance with increasing wavelength for samples with a thickness of D of about 1.7 nm, about 3.4 nm, about 5.0 nm, and about 6.7 nm. FIG. 4B illustrates the transmittance with increasing wavelength for samples with a thickness of D of about 2.2 nm, about 4.4 nm, about 6.6 nm, and about 8.8 nm. FIG. 4B illustrates the transmittance with increasing wavelength for samples with a thickness of D of about 2.8 nm, about 5.6 nm, and about 8.4 nm. For each thickness, the sheet resistance $R_{sh}$ is also shown in the spectrum. It can be seen that Ag films with larger d (sputtered with higher source powers) show better electrical performance. For instance, an Ag film with d=2.8 nm in FIG. 4C is weakly conductive, while the Ag film with two layers of d=2.2 nm in FIG. 4B has a sheet resistance of 190Ω/sq. The electrical performance is not significantly impaired by the oxide coating because the coating is very thin and the electrons are able to tunnel through the grain boundaries.

Films fabricated according to certain embodiments disclosed herein are transparent, and the optical transmittance varies with thickness, which is consistent with the different grain densities shown in FIGS. 2A-2H. Ag films with d=1.7 nm, for instance, exhibited an optical transmittance is as high as 91.8% at 330 nm for 3-layered (n=3) Ag film and 89.5% at 330 nm for 4 layered (n=4) Ag film. Such a high transmittance may allow for applications in ultraviolet sensors. Optical transmittance gradually decreases with increasing wavelength, but still maintains above 40%. In an embodiment, the transparency can be further improved by applying an anti-reflection coating layer may comprise a conducting transparent polymer. In an embodiment, an appropriate transparent conducting polymer that may be used as a anti-reflection coating layer may be, for example, Poly(3,4-ethylenedioxythiophene) Polystyrene sulfonate (PEDOT:PSS).

Figure 4D:
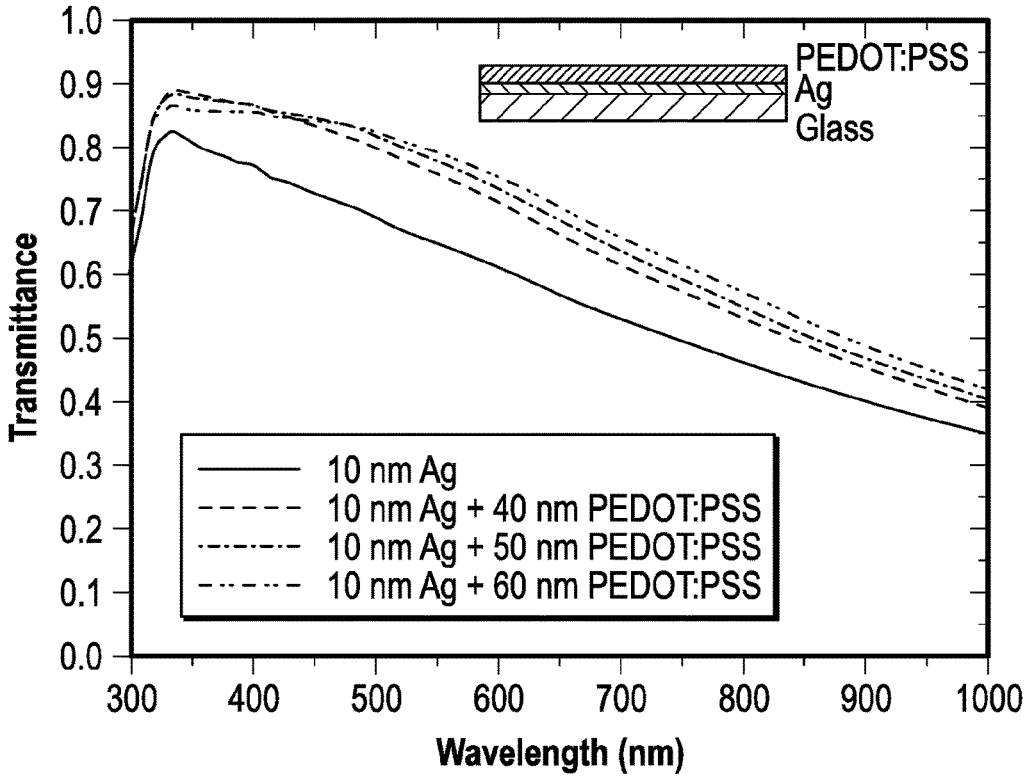

FIG. 4D is a simulation which illustrates PEDOT:PSS coating can lead to an improvement in optical transmittance by more than 10% as compared to the pre-coating values illustrated in FIGS. 4A-4C.

Figure 5:
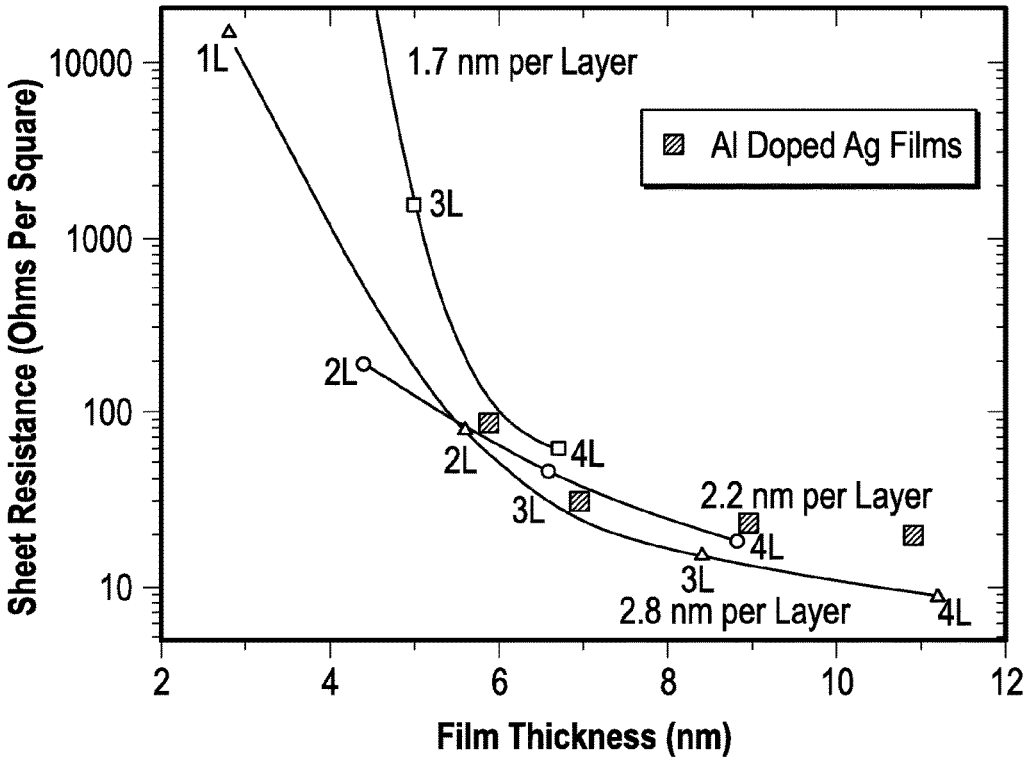
FIG. 5 illustrates a comparison of performance between thin films of different metallic compositions fabricated according to certain embodiments of the present disclosure.

A performance comparison of multi-layer Ag films with Al-doped Ag films is shown in FIG. 5. With the same overall thickness D, the Ag films with d=2.8 nm outperform the Al-doped Ag films. The significant improvement of electrical performance is also in consistent with the improved continuity shown in FIG. 2, which is the result of the effective suppression of Ostwald ripening. Compared with doping which only specifically works for one material, the methods disclosed herein are relatively versatile and is suitable for many metals and alloys.

Stretchability

The as-prepared Ag films show good stretchability, cyclability and recoverability. FIG. 5 presents the results of stretchability of a film with d=2.2 nm and n=4, deposited on a PDMS substrate with 30% pre-strain.

Figure 6A:
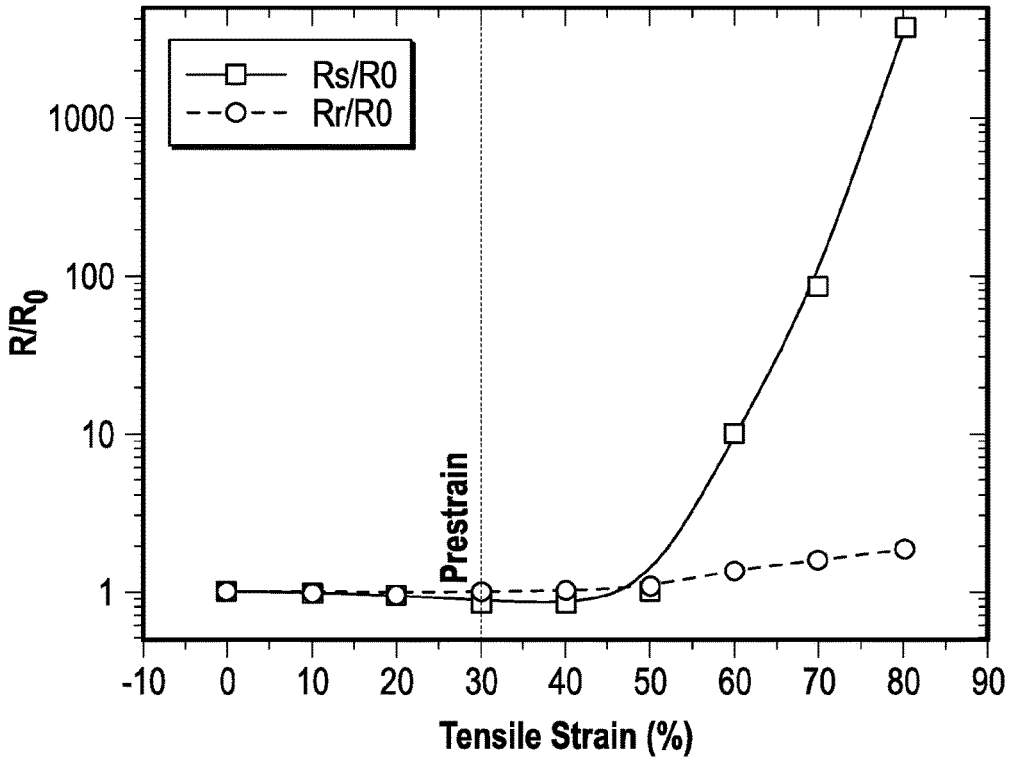
FIG. 6A is a graph of $R_s/R_0$ and $R_r/R_0$ (where $R_s$ is the resistance under stretching, $R_r$ the resistance after release, and $R_0$ the resistance before stretching) as a function of tensile strain.
Figure 6B:
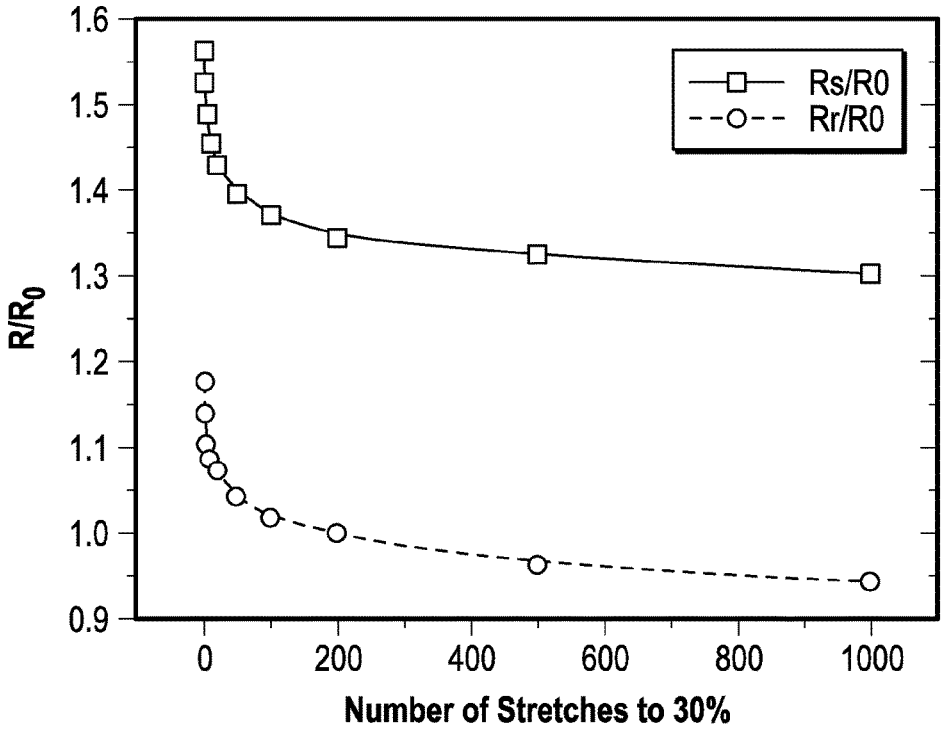
FIG. 6B is a graph of $R_s/R_0$ and $R_r/R_0$ as a function of the number of stretches.

Referring to FIGS. 6A and 6B, FIG. 6A is a graph of $R_s/R_0$ and $R_r/R_0$ as a function of tensile strain and FIG. 6B is a graph of $R_s/R_0$ and $R_r/R_0$ as a function of the number of stretches, where a single stretch comprises the application and removal of stress or strain to achieve a predetermined pre-strain value. $R_0$ is the original resistance of the Ag film before applying strains, and $R_s$ and $R_r$ denote the resistance measured under strain and after releasing of strain, respectively. Under tensile strain, R would increase because the stretching will cause damage to the film. After the strain is slowly released, R would decrease and approach the original value $R_0$ due to the recovery effect. At a certain critical point, the sheet resistance will rise rapidly when the damage overrides the recovery.

The Ag film shows impressive, desirable, stretchability. In order to get a larger stretchability, the Ag film is applied with a 30% pre-strain. As shown in FIG. 6A, there is no significant increase in resistance until reaching the critical strain above 50%. The slow increase implies that the film still holds global continuity despite ruptures. The Ag film also features excellent recovery, being able to recover completely from strain up to 50%, and an increase of only 88% in sheet resistance upon recovery from 80% strain.

Under cyclic stretching, the Ag film shows impressive stretchability and recovery as well. As shown in FIG. 6B, under cyclic stretching to 30% both ratios $R_s/R_0$ and $R_r/R_0$ keep decreasing even after 1000 cycles. During the first 200 cycles, $R_s/R_0$ decreases rapidly from 1.56 to 1.33 measured under strain, and from 1.17 to 1 measured after releasing of strain. Note here that all measurements were performed immediately after releasing the strain, implying a fast recovery.

Figure 7A:
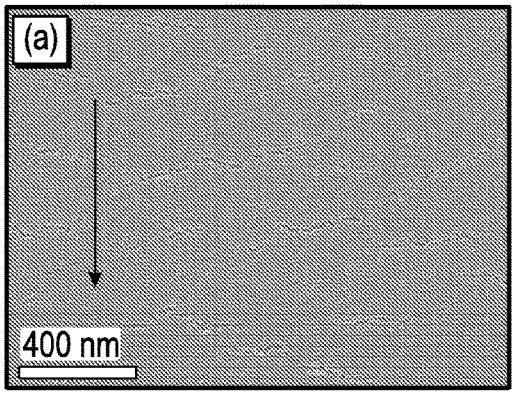
FIGS. 7A and 7B are SEM images of the film morphology under different amount of strain for films fabricated according to certain embodiments of the present disclosure.
Figure 7B:
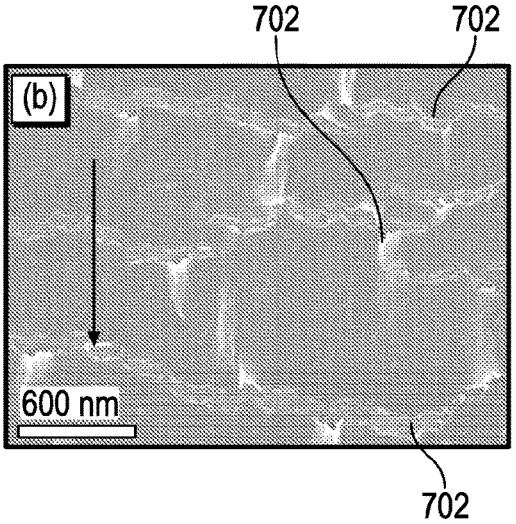

To have further insight into how the stretching affects the film, SEM images of the film morphology under different amount of strains are shown in FIGS. 7A and 7B. At first only small ruptures form in FIG. 7A, and the small ruptures do not significantly impact the sheet resistance as shown in FIG. 6A. When the strain is further increased, the cracks become larger and delaminations 702, as shown in FIG. 7B, start to form to release the local compressive strains generated by the elongation of the Ag film along the stretching direction.

It has been discovered that this kind of distributed rupture, typically long, closely packed slits, contributes greatly to the film's stretchability. Here the substrate plays an important role. It stabilizes slits from growing larger and promotes ruptures growing elsewhere, resulting in an even distribution of ruptures, as can be seen from FIG. 7B. Instead of forming a long wide crack, relatively small ruptures appear oriented but randomly distributed over the film. The elasticity of tape or PDMS also restricts the magnitude of the out-of-plane deformation, which is elastic and can contribute to the recovery of the film. The decrease in sheet resistance shown in FIG. 6B implies that cyclic stretching benefits the recovery of the film. That is, cyclic stretching redistributes the local displacements to make stress even in the film. The repeated stretching and compressing may cause welding within film layer and ruptures, leading to a better recovery, which is why a decrease in sheet resistance is observed in FIG. 6B. However, larger strains cause certain sites of stress concentration in the film, and these sites will eventually fail and permanent damage takes place. This results in the fast increase of resistance after certain critical strain.

Scratch Resistance

Figure 8A:
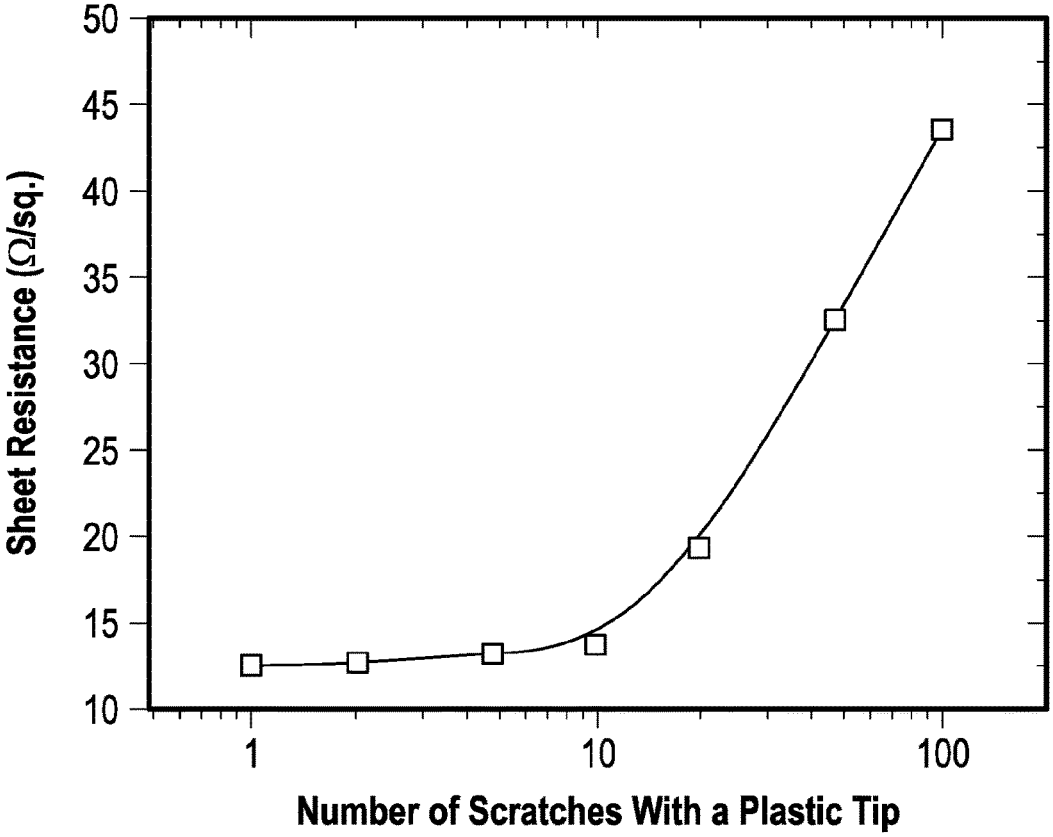
FIGS. 8A and 8B illustrate the sheet resistance and an SEM image of a thin film fabricated according to embodiments of the present disclosure.

To evaluate scratch resistance of the films fabricated according to embodiments of the present disclosure, a plastic tip (a standard 1 mL pipette tip) was used to scratch a Ag film (~8 nm) deposited on a tape for a number of times and observed the changing of sheet resistance. The Ag film also features a good scratch resistance. It is advantageous for FTEs to be durable enough to sustain possible damage that occurs during fabrication and usage to maintain a good working condition. FIG. 8A is a graph of the sheet resistance's dependence of the number of scratches N. The scratching strength of a pointed plastic tip on the Ag film is fairly intense and the applied strain is highly concentrated within the scratched area. Nevertheless, with scratches up to N=10, the sheet resistance barely increases. Even for N=100, the sheet resistance rises only from 12.5Ω/sq to 43.6Ω/sq, which is still fairly conducting.

Figure 8B:
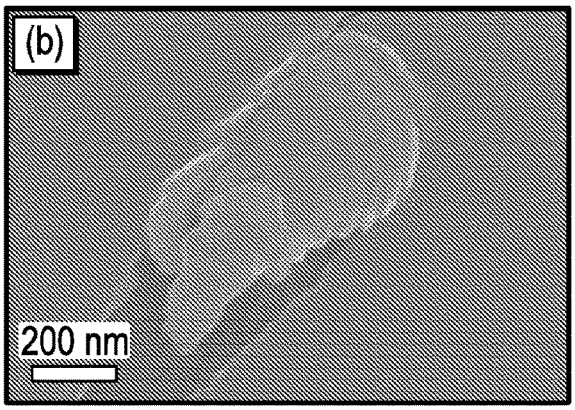

To have a better understanding about the scratch resistance, the surface morphology of the scratched Ag film is studied by SEM, which is shown in FIG. 8B When subjected to scratching, the Ag film shows good plasticity. Instead of peeling off completely and forming large scale fractures, the scratched area partially slips and wrinkles, releasing the local stresses. In this way, the plastic deformations minimize the damages caused by scratching and retain global continuity of the Ag film, resulting in the slow increase of the sheet resistance.

Exemplary embodiments are disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of broader terms such as "comprises," "includes," and "having" should be understood to provide support for narrower terms such as "consisting of," "consisting essentially of," and "comprised substantially of." Accordingly, the scope of protection is not limited by the description set out above but is defined by the claims that follow, that scope including all equivalents of the subject matter of the claims. Each and every claim is incorporated into the specification as further disclosure, and the claims are exemplary embodiment(s) of the present invention.

Unless expressly stated otherwise, the steps in a method claim may be performed in any order and with any suitable combination of materials and processing conditions.

What is claimed is:

1. A method of fabricating an electrode comprising: depositing a first metallic layer in contact with a substrate, wherein the substrate comprises glass, silicon, or a polymer; passivating the first metallic layer via exposure to air or oxygen gas to form a passivated first layer; depositing a second metallic layer in contact with the passivated first layer; and passivating the second metallic layer via exposure to air or oxygen gas, wherein each of the first and the second metallic layers comprises silver (Ag), copper (Cu), aluminum (Al), or a combination thereof, is continuous, and comprises a plurality of grains, wherein an average diameter of the plurality of grains is less than about 50 nm and wherein the electrode comprises an optical transmittance between 40% to about 89%.

2. The method of claim 1, wherein the substrate comprises polyethylene terephthalate or polydimethylsiloxane (PDMS).

3. The method of claim 1, wherein the substrate is flexible.

4. The method of claim 1, wherein the substrate is optically transparent.

5. The method of claim 1, wherein a thickness of the first metallic layer and a thickness of the second metallic layer are from about 0.5 nm to about 3.0 nm.

6. The method of claim 1, wherein at least one of a thickness of the first metallic layer and a composition of the first metallic layer is different than a thickness of the second metallic layer and a composition of the second metallic layer, respectively.

7. The method of claim 1, wherein passivating the first film, passivating the second film, or both comprise exposing the first metallic layer, the second metallic layer, or both to air or oxygen gas from about 1 second to about 60 seconds.

8. The method of claim 1, wherein depositing the first metallic layer and depositing the second metallic layer comprises using a vacuum deposition method of magnetron sputtering, electron beam evaporation, thermal evaporation, or ion sputtering.

9. The method of claim 1, further comprising, straining the substrate up to about 30% prior to depositing the first metallic layer in contact with the substrate.

10. The method of claim 1 further comprising depositing one or more additional metallic layers on the passivated second layer to form an additional deposited metallic layer, and passivating the one or more additional deposited metallic layers prior to depositing a subsequent of the one or more additional metallic layers thereon and in contact therewith.

11. The method of claim 10, wherein each of the one or more additional metallic layers comprises silver (Ag), copper (Cu), aluminum (Al), or a combination thereof.

12. An electrode comprising: a plurality of metallic layers deposited on a substrate, including a first metallic layer in contact with the substrate, wherein the substrate comprises glass, silicon, or a polymer; and an oxide layer between each adjacent pair of metallic layers, wherein each of the plurality of metallic layers comprises silver (Ag), copper (Cu), aluminum (Al), or a combination thereof, is continuous, and comprises a plurality of grains, wherein an average grain size in each metallic layer of the plurality of metallic layers is less than 50 nm as a result of passivation of each of the metallic layers prior to deposition of a subsequent of the plurality of metallic layers in contact therewith, and wherein the electrode comprises an optical transmittance between 40% to about 89%.

13. The electrode of claim 12, further comprising an anti-reflective layer comprising a conducting transparent polymer.

14. The electrode of claim 12, wherein the electrode comprises a thickness of less than about 15 nm.

15. The electrode of claim 14, wherein an average diameter of the plurality of grains is less than about 20 nm.

16. The electrode of claim 12, further comprising at least three metallic layers.

17. The electrode of claim 12, wherein the plurality of metallic layers is flexible.

18. The electrode of claim 12, wherein a thickness of each of the plurality of metallic layers is uniform, having a difference between a maximum and a minimum thickness of the layer that is within 20% of an average thickness of the layer.

* * * * *